US006769673B2

(12) United States Patent
Jäger

(10) Patent No.: US 6,769,673 B2
(45) Date of Patent: Aug. 3, 2004

(54) APPARATUS FOR THE GASIFICATION OF LIQUIDS

(75) Inventor: Claudius Jäger, Boulder, CO (US)

(73) Assignee: Gummi-Jäger KG GmbH & Cie (DE)

( * ) Notice: Subject to any disclaimer, the term of this patent is extended or adjusted under 35 U.S.C. 154(b) by 27 days.

(21) Appl. No.: 10/268,549

(22) Filed: Oct. 10, 2002

(65) Prior Publication Data

US 2004/0094849 A1 May 20, 2004

(30) Foreign Application Priority Data

Oct. 12, 2001 (DE) ..... 101 50 180

(51) Int. Cl.[7] ..... B01F 3/04
(52) U.S. Cl. ..... 261/122.2; 261/124
(58) Field of Search ..... 261/121.1, 122.1, 261/122.2, 124, DIG. 70; 210/220, 221.2

(56) References Cited

U.S. PATENT DOCUMENTS 3,953,555 A * 4/1976 Gley ..... 261/124
4,060,486 A * 11/1977 Schreiber ..... 210/220
4,118,447 A * 10/1978 Richter ..... 261/122.1
4,929,397 A * 5/1990 Jager ..... 261/65
5,304,301 A * 4/1994 Schmidt ..... 210/220
5,534,202 A * 7/1996 Roberts et al. ..... 261/122.1
6,367,783 B1 * 4/2002 Raftis ..... 261/122.1
6,464,211 B1 * 10/2002 Downs ..... 261/122.1
6,511,055 B2 * 1/2003 Jager ..... 261/122.1
6,619,633 B2 * 9/2003 Jager et al. ..... 261/122.2

FOREIGN PATENT DOCUMENTS

DE 33 19 161 11/1984
DE 36 00 234 7/1987

* cited by examiner

*Primary Examiner*—Scott Bushey
(74) *Attorney, Agent, or Firm*—R W Becker & Associates; R W Becker

(57) ABSTRACT

An apparatus is provided for the gasification or aeration of liquids. Elongated aeration elements are connected to a distribution conduit and have an essentially rigid support tube about which is disposed a membrane of elastomeric material. Compressed gas introduced between the support tube and membrane escapes via slits in the membrane. An elastically deformable fitting is disposed between the distribution conduit and one of the aeration elements, and is disposed in a bore in the conduit. The fitting has an essentially flat portion, one side of which rests against the outer surface of the conduit, and the other side of which rests against an end of the aeration element. A hollow bolt is securely connected to the aeration element and is guided through a bore in the fitting into the interior of the conduit, where it is provided with apertures.

8 Claims, 2 Drawing Sheets

APPARATUS FOR THE GASIFICATION OF LIQUIDS

BACKGROUND OF THE INVENTION

The present invention relates to an apparatus for the gasification of liquids, especially for the aeration of water.

Such apparatus are used, for example, in clarification plants. A plurality of aeration elements are disposed on a distribution conduit, whereby the distribution conduit on the one hand serves for the supply of air or gas to the aeration elements, and on the other hand also serves for the securement of the aeration elements. A plurality of distribution conduits can in turn be combined to form a system.

An elongated aeration element is disclosed in DE 33 19 161A1. In addition, DE 36 00 234 discloses an apparatus for the aeration of water, according to which individual aeration elements are connected with the distribution conduit via fittings that during assembly are pressed into a bore in the distribution conduit accompanied by elastic deformation, thereby forming a positive connection. However, the aeration elements are plate-shaped elements. Such a connection is not suitable for elongated aeration elements, which can have a length of up to one meter. When the apparatus moves or if there are flows in the liquid that is to be aerated, the long aeration elements act like lever arms, so that the forces that occur at the connection locations are much greater than is the case with plate-shaped aeration elements.

It is therefore an object of the present invention, for an apparatus of the aforementioned general type, to provide a connection between aeration element and distribution conduit that is suitable for long aeration elements, and in addition is elastic in order to be able to compensate for movements of the apparatus or flows in the liquid, and that nonetheless is easy to assemble and that requires only a few straightforward components.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
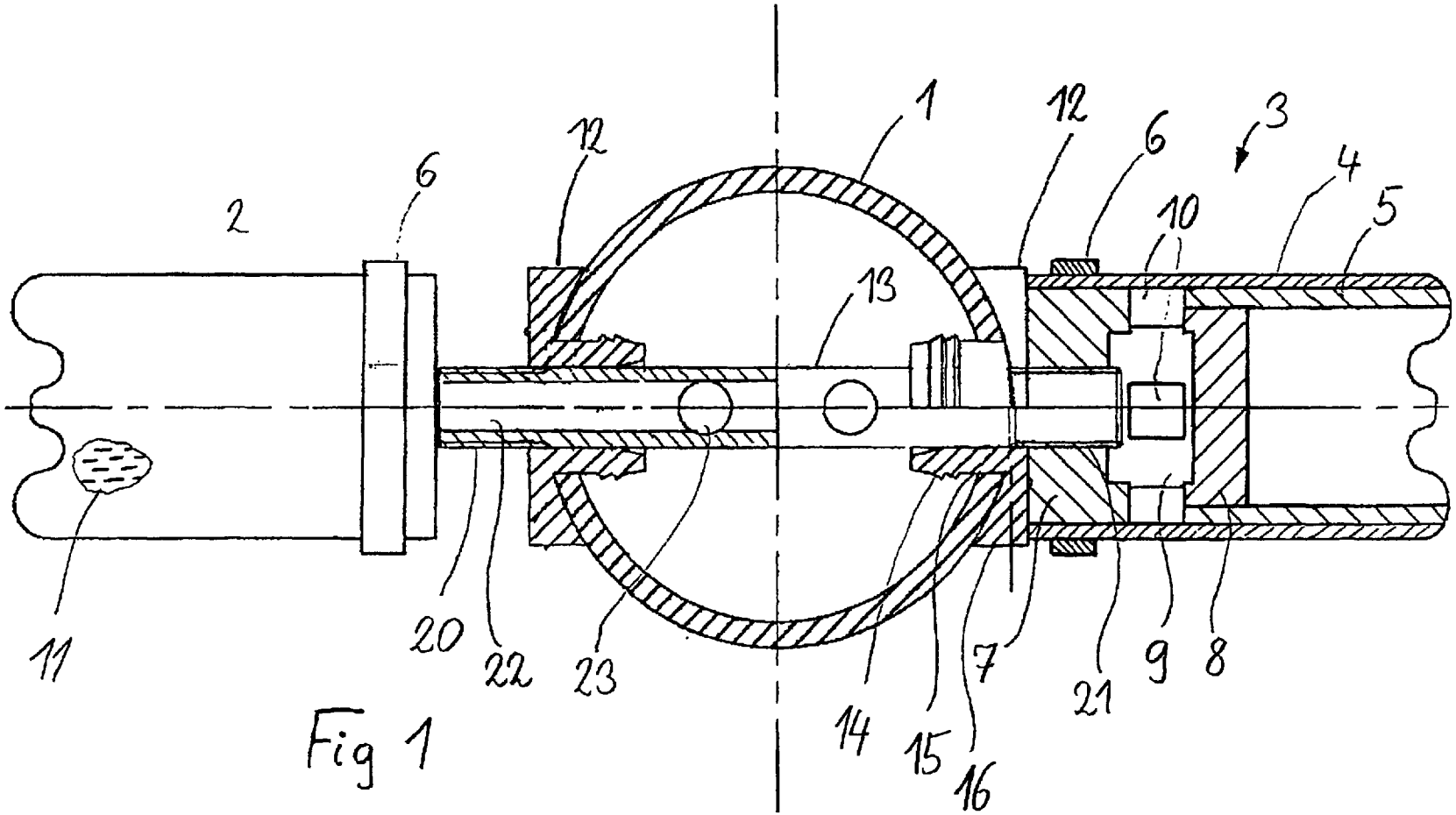
FIG. 1 shows one exemplary embodiment of an inventive apparatus.
Figure 2:
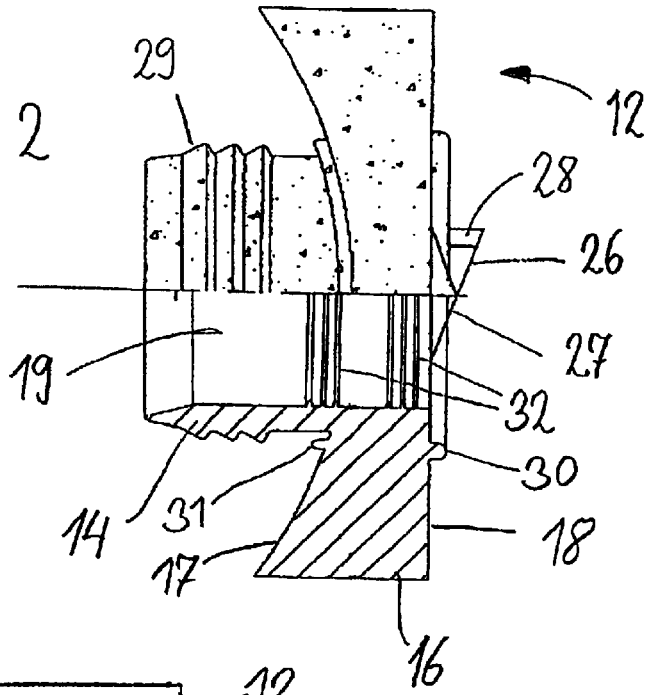
FIG. 2 is a side view of a fitting of the apparatus of FIG. 1.
Figure 3:
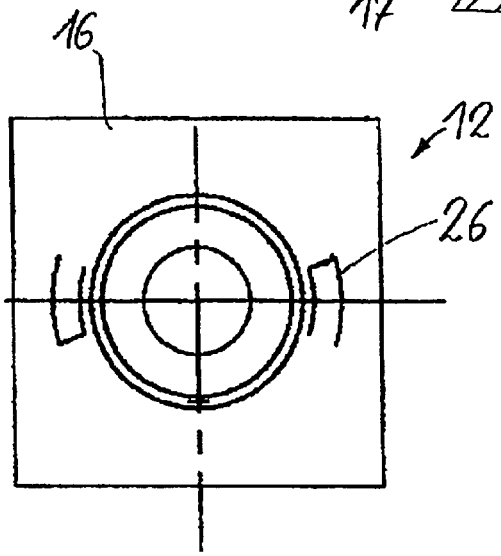
FIG. 3 is a plan view of the fitting of FIG. 2.

The object of the present invention is realized with an apparatus for the gasification or aeration of liquids, especially for the aeration of water, and includes elongated aeration elements that are connected with a distribution conduit that serves for the supply of gas or air, whereby each aeration element has an essentially rigid support tube with a membrane of rubber or a rubber-like polymeric material that is disposed on the support tube, and whereby compressed air or gas can be introduced between the support tube and the membrane and can escape into the liquid that is to be gasified via slits in the membrane; disposed between the distribution conduit and aeration element is an elastically deformable fitting of rubber, rubber-like material or some other elastomeric material, whereby the fitting is disposed in a bore that passes through the wall of the distribution conduit, with the fitting having a flat section, one side of which rests against the outer wall of the conduit and the other side of which rests against the end of the aeration element, and whereby a hollow bolt is securely connected with the aeration element and is guided through a bore in the fitting and into the interior of the distribution conduit, with the fitting being supported against the distribution conduit and being provided with apertures in its wall on that section thereof that is disposed in the interior of the distribution conduit.

As a consequence of the inventive fitting, an elastic mounting is achieved. The bolt serves not only for the mechanical connection, but also, due to its hollow configuration, for the transport of the air or gas from the distribution conduit to the aeration element. The bolt can be connected with the aeration element by being screwed thereto, whereby pursuant to one advantageous embodiment of the invention, due to an interlocking between aeration element and fitting it is possible to reliably prevent an undesired loosening or detachment of the screwed connection.

Pursuant to a particularly advantageous embodiment of the invention, aeration elements are respectively disposed in pairs on opposite locations on the distribution conduit, whereby in a given cross-sectional plane, the distribution conduit is provided at two oppositely disposed locations with bores through which a single bolt passes that connects the two aeration elements with one another. In this way, the support of the bolt relative to the wall of the distribution conduit is effected by the respectively other aeration element. The aeration elements thus reciprocally support one another, and the apparatus can make do with a minimum number of parts.

Further specific features of the present invention will be described in detail subsequently.

DESCRIPTION OF PREFERRED EMBODIMENTS

Referring now to the drawings in detail, the apparatus is provided with a distribution conduit 1 on which are disposed two aeration elements 2 and 3. The right aeration element 3 is shown in section, and the left aeration element 2 is illustrated as being dismounted from the distribution conduit 1. The aeration elements 2,3 extend perpendicular to the distribution conduit 1. The distribution conduit 1 can be equipped with a plurality of such pairs of aeration elements 2,3. The construction and manner of operation of the aeration elements 2,3 will be briefly explained subsequently.

Each of the aeration elements is provided with a support tube 5 of an essentially rigid material, for example a tough polymeric material, on which is disposed a hose-like membrane 4 that elastically surrounds the support tube 5 and in the following is also designated as a sleeve. The sleeve 4 is held by a clamp 6. In the drawing, only a short section of the elongated aeration elements 2 and 3 are shown. A clamp 6 can also be provided at the non-illustrated end of the aeration element for securing the sleeve 4 on the support tube 5.

The end of the aeration element 3 is closed off by a wall 7. The wall 7 can be connected with, or merged into, the support tube 5 in any desired manner. Formed between the wall 7 and a partition or intermediate wall 8 is a chamber 9 that serves for the supply of air to the aeration element 2,3. In the vicinity of the chamber 9, the wall of the support tube is provided with apertures 10.

The other, non-illustrated end of the support tube 5 is open, so that the water or other liquid that surrounds the apparatus has access to the interior of the support tube 5 up to the partition 8. As a consequence of this manner of construction, during operation only a small portion of the support tube 5 is filled with air, and the buoyancy of the apparatus is therefore low, which is of particular advantage for very long aeration elements 2,3.

The sleeve 4 is made of an elastic material, especially rubber or a rubber-like polymeric material. Furthermore, the sleeve 4 is provided with a plurality of fine slits, which as can be seen with respect to the aeration element 2 are designated by the reference numeral 11. However, these slits are provided only in that portion of the aeration element 2,3 that, as viewed from the securement location, is disposed behind or downstream of the partition 8, whereas the sleeve 4 has no slits in the region of the chamber 9.

During operation, compressed air flows from the chamber 9, via the apertures 10, between the support tube 5 and the sleeve 4, and escapes via the slits in the sleeve as fine bubbles into the surrounding liquid.

The important thing now is the connection of an aeration element 2 or 3 with the distribution conduit 1. A pin or bolt 13 serves for this purpose, and together with a fitting 12 extends through bores 15 in the distribution conduit 1.

The fitting 12 has an essentially cylindrical portion 14, and an essentially flat portion 16. The flat portion 16 rests against the outer surface of the distribution conduit 1, whereby it is provided with a concave abutment surface 17 that corresponds to the curvature of the outer surface of the distribution conduit. The opposite outer surface 18 of the fitting 12 rests against the wall 7 at the end of the aeration element 2 or 3.

The bolt 13 is guided through a bore 19 in the fitting 12. In the non-installed state, the diameter of the bore 19 is somewhat less than the outer diameter of the bolt 13. As a result, in the assembled state, the fitting 12 acts like a plug or socket, and holds the bolt 13 in the bore 15 of the distribution conduit 1 by a clamping effect. The ends of the bolt 13 are each provided with a thread 20 that serves for a connection with the aeration element 2 or 3. In turn, the aeration elements are provided with corresponding threaded bores 21 in their end walls 7.

In the cross-sectional plane illustrated in FIG. 1, the distribution conduit 1 has two bores 15 that are disposed at positions that are opposite one another on the periphery of the conduit 1. The length of the bolt 13 is such that it extends through both bores 15. The aeration elements 2 and 3 are therefore aligned with one another and reciprocally hold one another in that the bolt 13 is secured against being pulled out in the direction of one of the aeration elements due to the fact that the other aeration element is also screwed on.

The bolt 13 is embodied as a hollow tube. The central portion of the bolt is provided with apertures 23 via which the bore 22 in the interior of the bolt 13 communicates with the distribution conduit 1. By means of the apertures 23, air is guided out of the distribution conduit 1 and via the bore 22 into the chambers 9 of the two aeration elements 2,3, from where the air eventually passes via the membranes or sleeves 4 into the liquid that is to be gasified. The bolt 13 thus serves not only for the fastening of the aeration elements 2,3, but also for the supply of air or gas.

Figure 4:
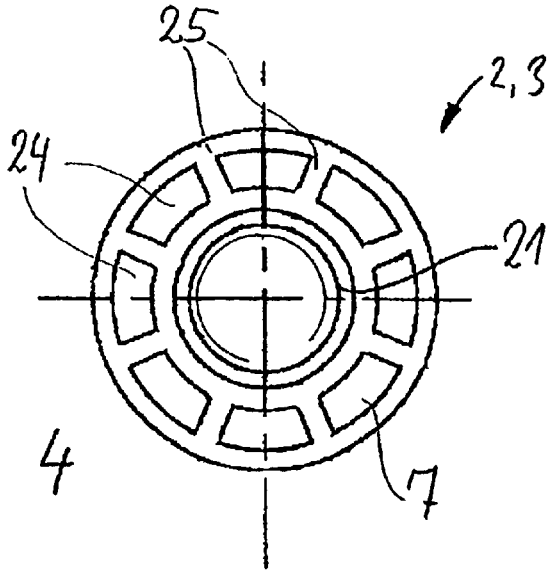
FIG. 4 is an end view of an aeration element of the apparatus of FIG. 1.

The apparatus is equipped with devices that prevent the components of the apparatus from becoming unintentionally detached. For example, each of the end walls 7 of the aeration elements 2 and 3 is provided in the region of its periphery with recessed areas 24 that, as can be seen in FIG. 4, are separated from one another by ribs 25 that extend in a spoke-like manner. That surface 18 of the fitting 12 that faces the aeration element is provided with wedge-shaped projections 26. When an aeration element 2 or 3 is screwed onto the bolt 13, the inclined surfaces 27 of the wedge-shaped projections 26 glide over the ribs 25 and finally engage in the recessed areas 24. The perpendicular surfaces 28 of the projections 26 then prevent an unscrewing, i.e. fitting 12 and aeration element 2 or 3 are interlocked.

The cylindrical portion 14 of the fitting 12 is provided with ribs 29 that on the side of the free end of the cylindrical portion 14 rise in a flat manner, while on the side of the flat portion 16 of the fitting 12 drop off more steeply. As a consequence of this barbed configuration of the portion 14, the fitting 12 is easy to insert into the bore 15, yet an undesired detachment is prevented.

It is furthermore important that with the apparatus of the present invention, all connection locations are sealed, and in particular not only to prevent unnecessary pressure losses, but also to prevent penetration of dirty water. In order to increase the sealing effect, the outer surfaces 17 and 18 of the flat portion 16 of the fitting 12, as well as in bore 19, are provided with circumferential sealing rings or ridges 30,31 and 32 that seal these components relative to the aeration elements 2,3, the distribution conduit 1, and the bolt 13.

The specification incorporates by reference the disclosure of German priority document DE 101 50 180.3 filed Oct. 12, 2001.

The present invention is, of course, in no way restricted to the specific disclosure of the specification and drawings, but also encompasses any modifications within the scope of the appended claims.

I claim:

1. An apparatus for the gasification or aeration of liquids, comprising:

a distribution conduit that serves for supplying compressed gas;

elongated aeration elements that are connected to said distribution conduit, wherein each aeration element is provided with an essentially rigid support tube about which is disposed a membrane of elastomeric material, and wherein compressed gas is introduced between said support tube and said membrane and can escape via slits in said membrane into a liquid that is to be gasified;

an elastically deformable fitting of elastomeric material, wherein said fitting is disposed between said distribution conduit and a given one of said aeration elements wherein said fitting is disposed in a bore that passes through a wall of said distribution conduit, wherein said fitting has an essentially flat portion, one side of which rests against an outer surface of said distribution conduit, and another side of which rests against an end of said given one of said aeration elements; and a hollow bolt that is securely connected with said given one of said aeration elements wherein said bolt is guided through a bore in said fitting and has a section that is disposed in an interior of said distribution conduit and is provided with apertures that provide communication between said interior of said distribution conduit and the interior of said bolt.

2. An apparatus according to claim 1, wherein in a cross-sectional plane of said distribution conduit two of said bores are provided on a periphery of said conduit at oppositely disposed positions, and wherein two of said aeration elements are aligned with one another by means of said bolt, which extends through respective ones of said bores in said fittings.

3. An apparatus according to claim 1, wherein said end of said aeration element is provided with a threaded bore into which said bolt is threaded.

4. An apparatus according to claim 1, wherein that side of said flat portion of said fitting that rests against said outer surface of said distribution conduit is provided with a curvature that corresponds to said outer surface of said distribution conduit.

5. An apparatus according to claim 1, wherein said bore in said fitting has a diameter that is less than a diameter of said bolt.

6. An apparatus according to claim 3, wherein said threaded connection between said bolt and said aeration element is secured via an interlocking means between contacting surfaces of said aeration element and said fitting.

7. An apparatus according to claim 6, wherein that side of said fitting that rests against said end of said aeration element is provided with at least one wedge-shaped projection that cooperates with recessed areas on said end of said aeration element, wherein said wedge-shaped projections have flatly rising surfaces on which wall portions of said end of said aeration element which wall portions delimit said recessed areas, slide when said aeration element and said bolt are threaded together, and wherein said wedge-shaped projections have steeply dropping surfaces against which said wall portions rest when said aeration element and said bolt are unthreaded from one another.

8. An apparatus according to claim 1, wherein at least one ribbed sealing ridge is provided on at least one of said side of said fitting that rests against said end of said aeration element, said side of said fitting that rests against said outer surface of said distribution conduit, and in said bore in said fitting.

* * * * *